United States Patent [19]

Reid et al.

[11] 4,402,180

[45] Sep. 6, 1983

[54] OIL PRESSURE MONITORING SYSTEM

[75] Inventors: Matthew R. Reid, St. Giles; Kenneth J. Hart, Ruislip, both of England

[73] Assignee: Rolls-Royce Limited, London, England

[21] Appl. No.: 260,837

[22] Filed: May 5, 1981

[30] Foreign Application Priority Data

Jun. 19, 1980 [GB] United Kingdom ..... 8020136

[51] Int. Cl.[3] ..... F02C 7/06

[52] U.S. Cl. ..... 60/39.08; 184/6.11

[58] Field of Search ..... 60/39.08; 184/1 C, 6.11; 415/118

[56] References Cited

U.S. PATENT DOCUMENTS

| | | | |
|---|---|---|---|
| 2,243,074 | 5/1941 | Anderson | 184/1 C |
| 2,602,583 | 7/1952 | Haeberlein | 184/6.11 |
| 3,347,553 | 10/1967 | Schweiger | 60/39.08 |
| 3,378,104 | 4/1968 | Venable | 60/39.08 |
| 3,545,571 | 12/1970 | Kirkpatrick | 184/6.11 |

*Primary Examiner*—Louis J. Casaregola

*Attorney, Agent, or Firm*—Cushman, Darby & Cushman

[57] ABSTRACT

An oil pressure monitoring system for a gas turbine engine having a compressor and a bearing chamber adapted to be supplied with pressurized oil and having means for the drainage of oil therefrom and which is sealed against oil leakage therefrom by pressurized air derived from the compressor. The system comprises first and second switches which are adapted to be actuated by pressure differential, each at different pressure differential values and which are responsive to both the delivery pressure of oil supplied to the bearing chamber and to the pressure of sealing air derived from the engine compressor. A resistance network and a ratiometer are associated with the switches. The arrangement is such that the ratiometer indicates whether the switches have been actuated.

5 Claims, 2 Drawing Figures

Figures 1, 2:
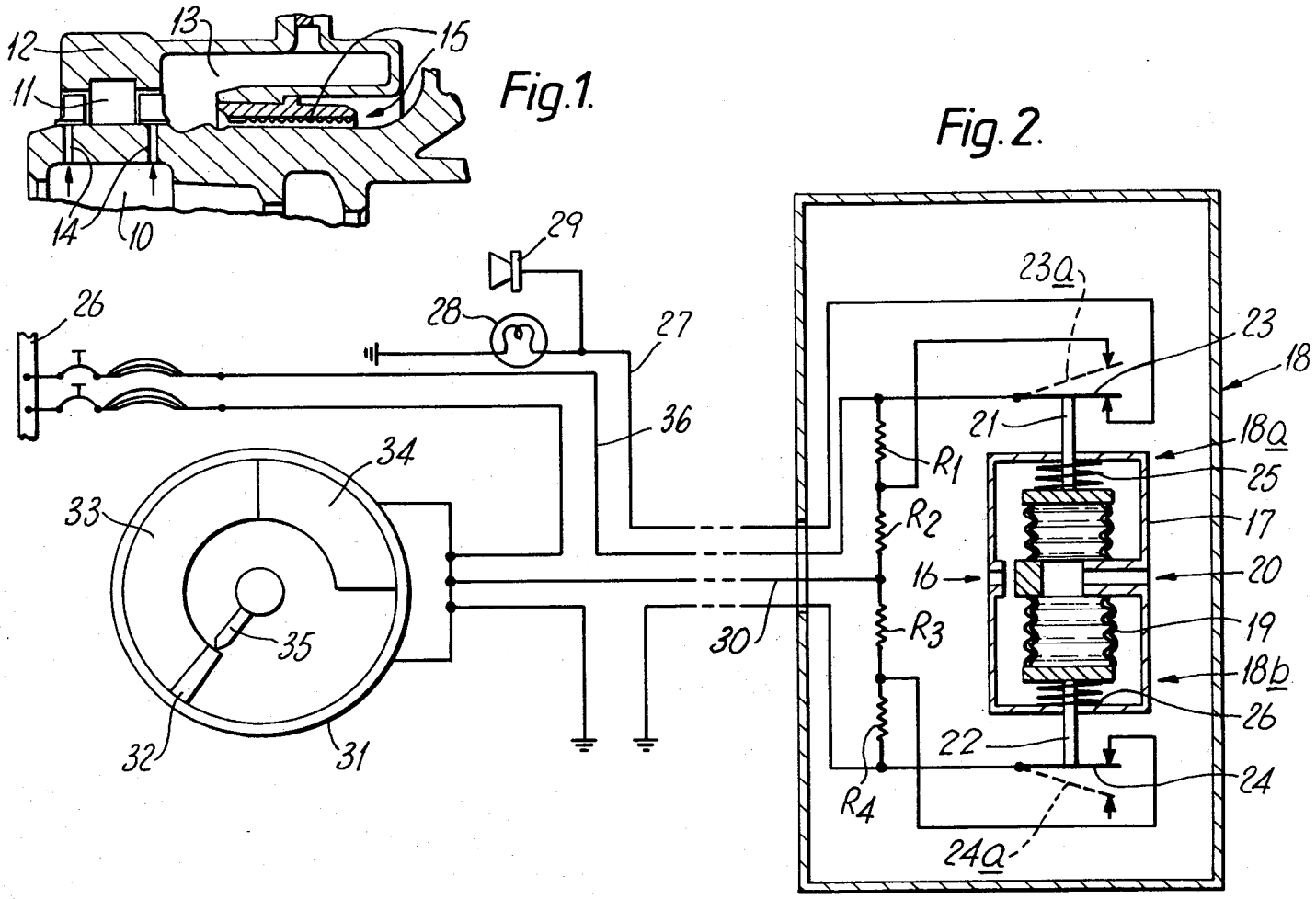

18
18a
18b
16
17
19
20
21
22
23
23a
24
24a
25
26
R1
R2
R3
R4
27
28
29
30
31
32
33
34
35
36
10
11
12
13
14
15

OIL PRESSURE MONITORING SYSTEM

This invention relates to an oil pressure monitoring system and in particular to an oil pressure monitoring system suitable of a gas turbine engine.

The pressure of oil contained in the oil supply system of a gas turbine engine is obviously vital to the efficient operation of that engine: any reduction in oil pressure below certain levels usually resulting in an insufficient supply of oil to bearings and in turn to some degree of engine damage and perhaps failure. It is the usual practice therefore to provide a system for monitoring engine oil pressure in order that any pressure reductions may be detected so that appropriate measures may be taken to avoid engine damage.

Gas turbine engine oil pressure monitoring systems conventionally comprise a transducer referenced against atmospheric pressure and positioned at an appropriate point in the oil supply system, and indicator means, adapted to indicate the electrical output of the transducer. Thus under normal engine operating conditions, the indicator means provides a continuous indication of oil pressure relative to atmospheric pressure. There are, however, circumstances in which such oil pressure monitoring systems provide misleading indications of oil pressure. Thus for instance, if the engine has been operating at a high speed for some time and is then suddenly reduced to a low speed or idling, the low viscosity of the oil resulting from its high temperature will result in a low oil pressure reading on the indicator means. The indicator means may therefore indicate that the oil pressure is unsatisfactory whereas in fact sufficient oil is being supplied to the various bearings in the engine.

A further problem associated with oil pressure monitoring systems of type is that of reading the oil pressure indicator means with any degree of accuracy. Thus indicator means are conventionally divided into three zones, green, amber and red, which indicate satisfactory, cautionary and unsatisfactory engine oil pressures. If the pointer of the indicator means is in the vicinity of the boundary between two zones, confusion can occur, especially in environments, such as helicopter cockpits, where vibration can occur. Moreover, fluctuations in oil pressure can also give rise to confusing pressure indications and sometimes lead to premature transducer failure.

It is an object of the present invention to provide an improved oil pressure monitoring system for a gas turbine engine which system provides a clear and representative indication of whether the engine oil pressure is satisfactory, cautionary or unsatisfactory.

According to the present invention, an oil pressure monitoring system for a gas turbine engine having a compressor and a bearing chamber adapted to be supplied with pressurised oil, having means for the drainage of oil therefrom and which is sealed against oil leakage therefrom by pressurised air derived from said compressor comprises first and second switches adapted to be actuated by pressure differential, each of said pressure differential switches being responsive to both the delivery pressure of said oil supplied to said chamber and to the pressure of said sealing air derived from said compressor, said first switch being adapted to be actuated at an oil pressure which is a predetermined first value greater than said air pressure and said second switch being adapted to be actuated at an oil pressure which is a predetermined second value greater than said air pressure, said second value being greater than said first value, and indicator means associated with said switches, said indicator means being adapted to indicate whether said first and second pressure differential switches have been actuated.

Said oil pressure monitoring system may comprise a ratiometric indicator and a resistance network, said resistance network being interposed between said ratiometric indicator and said pressure differential switches and so arranged that said ratiometric indicator indicates any one of three values depending upon whether (a) neither of said pressure differential switches have been actuated, (b) only one of said pressure differential switches has been actuated or (c) both of said pressure differential switches have been actuated.

Said oil pressure monitoring system may be provided with audio and/or additional visual indicator means adapted to be activated when neither of said pressure differential switches has been actuated.

Each of said pressure differential switches preferably comprises a circuit selecting switch and a chamber enclosing a hollow deformable member, said pressurised air being supplied to the interior of said chamber and said pressurised oil being supplied to the interior of said deformable member, said deformable member being adapted to actuate said circuit selecting switch.

Each of said pressure differential switches preferably share a common chamber and a common deformable member, said deformable member being adapted to actuate two circuit selecting switches, biassing means being associated with each of said switches and so arranged that said switches are respectively actuated only when said oil pressure is at said predetermined first and second values greater than said air pressure.

The invention will now be described, by way of example, with reference to the accompanying drawings in which:

FIG. 1 is a sectional side view of a typical bearing chamber in a gas turbine engine and, FIG. 2 is a diagrammatic representation of an oil pressure monitoring system in accordance with the present invention.

With reference to FIG. 1, a gas turbine engine, a portion of which is shown, is provided with a hollow shaft 10 which is mounted on a bearing 11. The bearing 11 is mounted in turn on a static engine portion 12. The shaft 10 and static engine portion 12 together serve to define a bearing chamber 13 which encloses the bearing 11. Oil is supplied to the bearing 11 through a plurality of supply passages 14 in the shaft 10 two of which can be seen in FIG. 1. In operation, pressurised oil is directed to the bearing 11 where it serves to lubricate the bearing 11 before passing into the bearing chamber 13. The bearing chamber 13 is provided with drainage ducts (not shown) through which the oil is drained to be returned to the oil tank of the engine for re-use.

The static engine portion 12 is provided with an annular sealing portion 15 which is located adjacent part of the shaft 10. The sealing portion 15 is of the well known labyrinth type and is intended to prevent the leakage of oil from the bearing chamber 13.

In order for the sealing portion 15 to function in this manner, pressurised air derived from the low pressure section of the gas turbine engine compressor is ducted to it so that the air pressure externally of the bearing chamber 13 is greater than that internally thereof. The bearing chamber 13 is provided with venting means, (not shown) which ensure that the air pressure within the bearing chamber 13 does not rise to the same level as that of the air externally of the chamber 13. Consequently there is a flow of air between the sealing portion 15 and the shaft 10 which is in such a direction as to oppose any leakage of oil from the chamber 13.

Such air sealing of bearing chambers in gas turbine engines is well known and does not therefore constitute any part of the present invention.

Air derived from the gas turbine engine compressor and at the same pressure as that which serves to prevent oil leakage from the bearing chamber 13 is directed through a port 16 to the interior of a closed chamber 17 which constitutes part of a pressure differential switching mechanism generally indicated at 18 in FIG. 2. The pressure differential switching mechanism comprises two pressure differential switches generally indicated at 18*a* and 18*b*. The chamber 17 encloses a hollow deformable member 19 which is not in communication with the interior of the chamber 17 and is provided with a port 20 which terminates externally of the chamber 17. Oil at the same pressure as that which is delivered to the bearing 11 is directed into the interior of the hollow member 19 through the port 20.

The hollow member 19 is provided with two actuating arms 21 and 22 which extend through the wall of the chamber 17 to terminate at circuit selecting switches 23 and 24 respectively.

It will be seen therefore that any difference between the oil pressure within the hollow member 19 and the air pressure within the chamber 17 will result in the hollow member 19 deforming and causing the actuating arms 21 and 22 to operate the circuit selecting switches 23 and 24.

Resilient biassing springs 25 and 26 are interposed between the exterior of the hollow member 19 and the interior of the chamber 17, so that they surround the actuating arms 21 and 22 respectively. The springs 25 and 26 are set at different pre-loads so that the circuit selecting switches 23 and 24 are actuated at different pressure differences between the oil and air contained within the chamber 17. The positions of the circuit selecting switches 23 and 24 shown in FIG. 2 are those which they adopt when the pressure of the oil within the hollow member 19 is the same as or less than the air pressure within the chamber 17.

Thus the circuit selecting switch 23, the actuating arm 21, the resilient biassing spring 25, the hollow member 19 and the chamber 17 constitute one pressure differential switch 18*a* and the circuit selecting switch 24, the actuating arm 22, the resilient biassing spring 26, the hollow member 19 and the chamber 17 constitute the other pressure differential switch 18*b*. Consequently the hollow member 19 and the chamber 17 are common to both pressure differential switches 18*a* and 18*b*. It will be appreciated, however, that this is not an essential feature and that in fact their could be two of each of the hollow member 19 and the chamber 17.

The circuit selecting switch 23 is supplied with electrical power through a line 36 which is in communication with a power source 26 maintained at a positive potential. When the circuit selector switch 23 is in the position shown in FIG. 2, electrical power is fed to ground through a line 27 which is provided with a warning light 28 and an audible warning device 29. Throughout this specification, the term "ground" is to be understood as meaning a return path to a conductor (not shown) which is maintained at a negative potential relative to the positive power source 26 and reference to the term "grounded" should be construed accordingly. The line 35 is additionally connected in series with three resistors $R_1$, $R_2$ and $R_3$, which are grounded via the circuit selector switch 24 when that switch 24 is in the position shown in FIG. 2. A tapping 30 between resistors $R_2$ and $R_3$ is fed to a ratiometer 31 which is also grounded. The term "ratiometer" is to be understood as meaning a device adapted to indicate the ratio of two currents or voltages. The face of the ratiometer is divided up into three segments 32, 33 and 34 and is provided with an indicator or pointer 35 which is adapted to be directed towards any one of these segments.

When the circuit selector switches 23 and 24 are in the positions shown in FIG. 2, the pressure of oil within the hollow member 19 is the same or less than that of the air within the chamber 17. Such a situation will arise if there is no oil flow into the bearing chamber 13. Thus electrical power will be directed to ground through the line 27 via the warning light 28 and audible warning device 29, thereby giving both visual and audible evidence of an oil supply failure to the bearing chamber 13. Additionally electrical power will be fed to ground via the resistors $R_1$, $R_2$ and $R_3$, the circuit selecting switch 24 and the ratiometer 31. The arrangement of the resistors $R_1$, $R_2$ and $R_3$ is such that the reading on the ratiometer is proportional to $(R_1+R_2)/R_3$.

The actual values of the resistors $R_1$, $R_2$ and $R_3$ are selected such that in this situation, the ratiometer indicator 35 is directed towards sector 32. Sector 32 is conveniently coloured red and is thus indicative of an oil supply failure to the bearing chamber 13. It will be seen therefore that the ratiometer 31, the warning light 28 and the audible warning device 29 will all give a warning of an oil supply failure.

These indications of oil supply failure continue until the circuit selector switch 23 is actuated and overcomes the position shown and moves to the position shown in interrupted lines at 23*a*. The biassing spring 25 is preloaded such that the circuit selector switch 23 is actuated when the pressure of the oil within the hollow member 19 is greater than the pressure of the air within the chamber 17 by a predetermined value. The predetermined value is one which ensures that the oil pressure is sufficiently greater than the air pressure to provide an oil flow into the bearing chamber 13 which is adequate to provide lubrication if the gas turbine engine is operated under cautionary conditions.

When the circuit selecting 23 switch assumes the position shown at 23*a*, the resistor $R_1$ is bypassed and the power supply to the warning light 28 and audible moving device 29 discontinued. This has the result of providing a ratiometer 31 reading which is proportional to $R_2/R_3$. The values of $R_2$ and $R_3$ are such that the ratiometer's indicator or pointer 35 moves into the mid portion of the sector 33. Sector 33 is conveniently coloured amber so as to be indicative of cautionary gas turbine engine operating conditions.

The ratiometer indicator remains in the amber sector 33 until the circuit selector switch 24 is actuated and assumes the position shown in interrupted lines at 24*a*. The pre-loading of the biassing spring 26 is selected such that the circuit selector switch 24 is actuated when the pressure of the oil within the hollow member 19 is greater than the pressure of the air within the chamber 18 by a second predetermined value. The second predetermined value is greater than the first predetermined value and is one which ensures that the oil pressure is sufficiently greater than the air pressure to provide an oil flow into the bearing chamber 13 which is adequate under all normal engine operating conditions.

When the circuit selecting switch 24 assumes the position shown at 24*a*, the circuit selecting switch 23*a* will of course still be in the position shown at 23*a*. Moreover, when in the position shown at 24*a* the circuit selecting switch 24 breaks the link between the resistor $R_3$ and ground. However, a link between resistor $R_5$ and earth remains but via a fourth resistor $R_4$. This has the result of providing a ratiometer 31 reading which is proportional to $R_2/(R_3+R_4)$. The values of $R_2$, $R_3$ and $R_4$ are such that the ratiometer indicator moves into the mid portion of the sector 34. Sector 34 is conveniently coloured green so as to be indicative of an oil flow into the bearing chamber 13 which is adequate under normal engine operating conditions.

The ratiometer 31 together with the warning light 28 and the audible warning device 29 are conveniently located in an aircraft cockpit. Together they provide a clear indication of the rate of oil supply to the bearing chamber 13. Thus if the rate of oil supply is unsatisfactory, the ratiometer's indicator or pointer 35 will be in the red sector 32 and the warning light 28 and audible warning device 29 activalent. However, if the rate of supply is adequate under conditions of caution, it will be in the amber sector 33 and in the green sector 34 if the rate of supply is adequate under normal engine operating conditions.

Since the pressure of oil supplied to the bearing chamber 13 is referenced to the pressure of air required to seal the chamber 13 and not to atmospheric pressure, then instead of being just an indication of oil pressure, the ratiometer 31 provides a representative indication of the rate at which oil is supplied to the bearing chamber 13. Since bearings are dependent for efficient operation upon the rate which oil is supplied to them rather than the pressure of that oil relative to atmospheric pressure, then the oil pressure monitoring system in accordance with the present invention provides an improved indication of oil system effectiveness.

We claim:

1. In an oil pressure monitoring system for a gas turbine engine having a compressor, a bearing chamber, means to supply pressurized oil to said chamber, drainage means from said chamber for draining pressurized oil therefrom, sealing means for said chamber to prevent oil leakage therefrom, said sealing means supplying pressurized air from said compressor to externally of said chamber, the improvement in said oil pressure monitoring system comprising:

a first pressure differential switch means responsive to a pressure differential between pressure of oil supplied to said chamber and to pressure of air supplied by said compressor, said first pressure differential switch means being actuated when said pressure of oil is at a predetermined first value greater than said pressure of air;

a second pressure differential switch means responsive to a second pressure differential between oil supplied to said chamber and to pressure of air supplied by said compressor, said second pressure differential switch means being actuated when said pressure of oil is at a second value greater than said pressure of air, said second value being greater than said first value; and indicator means having a pointer movable between a first position indicating rate of oil supply to said bearing chamber is unsatisfactory, a second position indicating rate of oil supply to said bearing chamber is adequate under conditions of caution, and a third position indicating rate of oil supply to said bearing chamber is adequate under normal engine operating conditions, said indicator means including an electrical circuit means operatively connected to said first pressure differential switch means and to said second pressure differential switch means, said electrical circuit means including a first circuit actuated when neither of said first and second pressure differential switch means has been actuated so as to cause said pointer to move to said first position, a second electrical circuit actuated when said first pressure differential switch means is actuated to cause said pointer to move to said second position, and a third electrical circuit actuated when both of said first and second pressure differential switch means have been actuated to cause said pointer to move to said third position.

2. An oil pressure monitoring system as claimed in claim 1 in which said electrical circuit means includes a plurality of resistors, a first ratio of said resistors being actuated when said first circuit is actuated, a second ratio of said resistors being actuated when said second electrical circuit is actuated, and a third ratio of resistors actuated when said third electrical circuit is actuated.

3. An oil pressure monitoring system as claimed in claim 1 including audio indicator means operatively connected to said first electrical circuit and actuated when said first electrical circuit is actuated.

4. An oil pressure monitoring system as claimed in claim 1 wherein each of said pressure differential switch means comprises a circuit selecting switch, a hollow deformable member operatively connected to each of said circuit selecting switches to actuate the same, and a chamber enclosing said hollow deformable member, means for supplying pressurized air to said chamber and means for supplying pressurized oil to said deformable member.

5. An oil pressure monitoring system as claimed in claim 4 wherein each of said first and second pressure differential switch means shares a common chamber and a common deformable member, said deformable member being operatively connected to both of said circuit selecting switches, and in which biasing means is provided for each of said circuit selecting switches, said biasing means being arranged so that said circuit selecting switches are respectively actuated only when said oil pressure is at said first predetermined value and said second predetermined value greater than said air pressure.

* * * * *